US005692266A

United States Patent [19]

Tsai

[11] Patent Number: 5,692,266

[45] Date of Patent: Dec. 2, 1997

[54] CONCEALABLE AND EXPANDABLE HANDLE

[76] Inventor: James Tsai, 103, Ta-Ming 1 Rd., Tung Pao Tsun, Tan Tzu Hsiang, Taichung Hsien, Taiwan

[21] Appl. No.: 680,548

[22] Filed: Jul. 9, 1996

[51] Int. Cl.[6] ..... A47B 95/02

[52] U.S. Cl. ..... 16/115; 280/655; 280/655.1; 280/47.315

[58] Field of Search ..... 16/115; 190/39, 190/115, 18 A; 280/655, 655.1, 47.315

[56] References Cited

U.S. PATENT DOCUMENTS

| | | | |
|---|---|---|---|
| 5,400,472 | 3/1995 | Chang | 16/115 |
| 5,431,428 | 7/1995 | Marchwiak | 16/155 |
| 5,438,731 | 8/1995 | Kazmark | 16/115 |
| 5,488,756 | 2/1996 | Hsieh | 280/655 |
| 5,499,702 | 3/1996 | Wang | 190/39 |
| 5,502,876 | 4/1996 | Wang | 280/655 |
| 5,526,908 | 6/1996 | Wang | 280/655 |
| 5,581,846 | 12/1996 | Wang | 16/115 |

*Primary Examiner*—Chuck Mah
*Assistant Examiner*—Mark Williams
*Attorney, Agent, or Firm*—Browdy and Neimark

[57] ABSTRACT

A concealable and expandable handle comprises two outer tubes, two inner tubes, a hand grip, two retaining and arresting mechanisms, the connection rods, two linking members, and a press button. The outer tubes are provided respectively at the bottom end thereof with an elastic element fastened therewith. When the hand grip and the inner tubes are caused by the retaining and arresting mechanisms to remain in the state of contraction, the elastic elements are so compressed as to store the rebounding energy. As the press button is pressed to cause the hand grip and the inner tubes to be relieved of the arresting action of the retaining and arresting mechanisms, the hand grip and the inner tubes are caused by the rebounding energy stored in the compressed elastic elements to bounce out automatically.

5 Claims, 5 Drawing Sheets

CONCEALABLE AND EXPANDABLE HANDLE

FIELD OF THE INVENTION

The present invention relates generally to a handle for use in a luggage or push cart, and more particularly to a concealable and expandable handle for use in a luggage or push cart.

BACKGROUND OF THE INVENTION

The Taiwanese Patent Serial No. 83203471 discloses an expandable handle, which is provided at the center thereof with a press button. As the press button is pressed, the outer ends of two link members are forced to warp so as to actuate two connection rods to displace upwards, thereby resulting in the releasing motion of the retaining member connected with the connection rods. As a result, the inner tube is caused to move along the outer tube.

Such a prior art expandable handle as described above is relatively complicated in construction and can not be therefore assembled easily.

SUMMARY OF THE INVENTION

It is therefore the primary objective of the present invention to provide an expandable handle which can be concealed handily.

It is another objective of the present invention to provide an expandable and concealable handle which can be assembled with ease and precision.

The foregoing objectives of the present invention are attained by an innovative handle, which comprises two outer tubes, two inner tubes, a hand grip, two retaining and arresting mechanisms, two connection rods, two linking members, and a press button. The outer tubes are provided respectively at the bottom end thereof with an elastic element fastened therewith. When the hand grip and the inner tubes are caused by the retaining and arresting mechanisms to remain in the state of contraction, the elastic elements are so compressed as to store the rebounding energy. As the press button is triggered to cause the hand grip and the inner tubes to be relieved of the arresting action of the retaining and arresting mechanisms, the hand grip and the inner tubes are caused by the rebounding energy stored in the elastic elements to bounce out automatically.

DETAILED DESCRIPTION OF THE INVENTION

Figure 1:
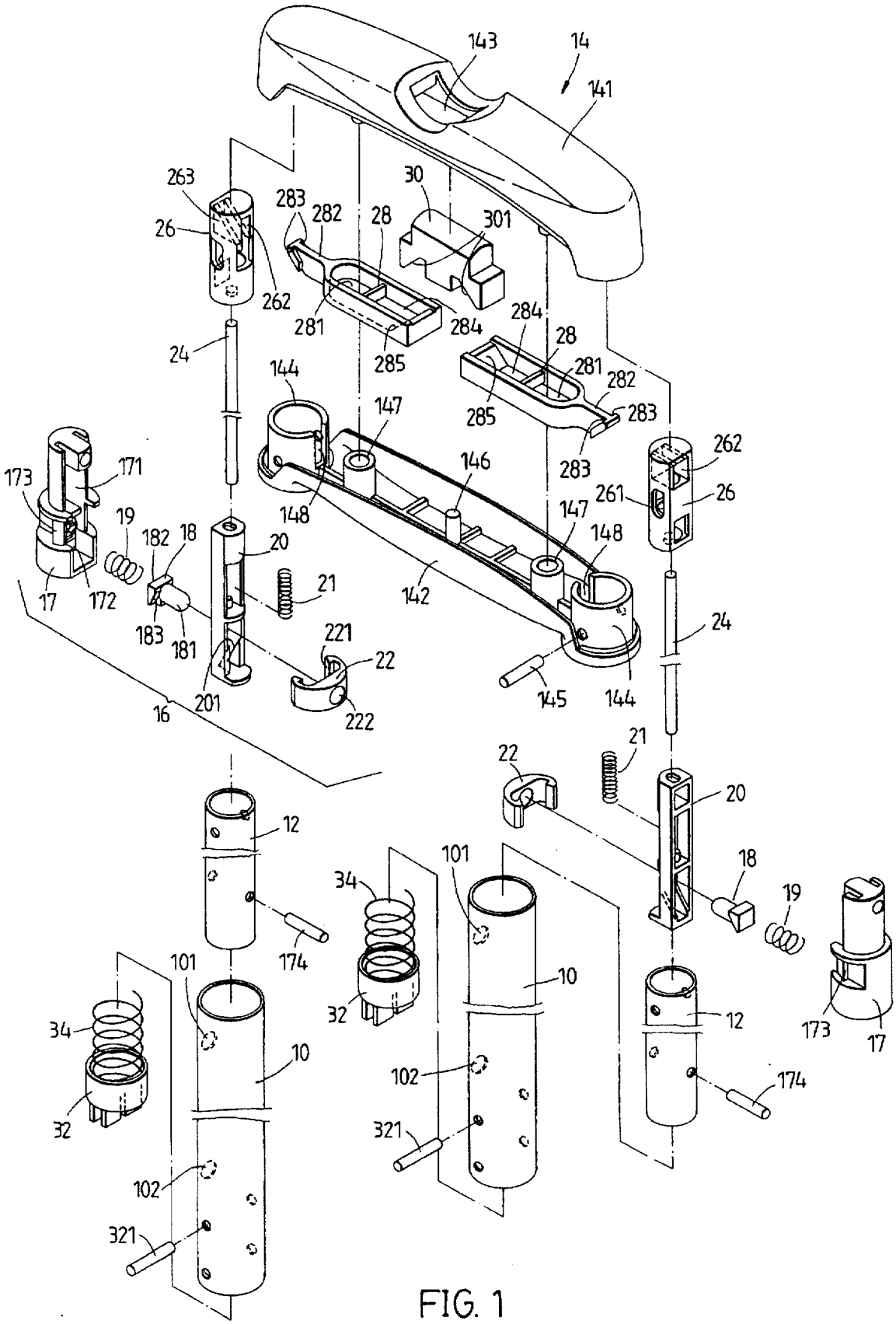
FIG. 1 shows an exploded view of the present invention.
Figure 2:
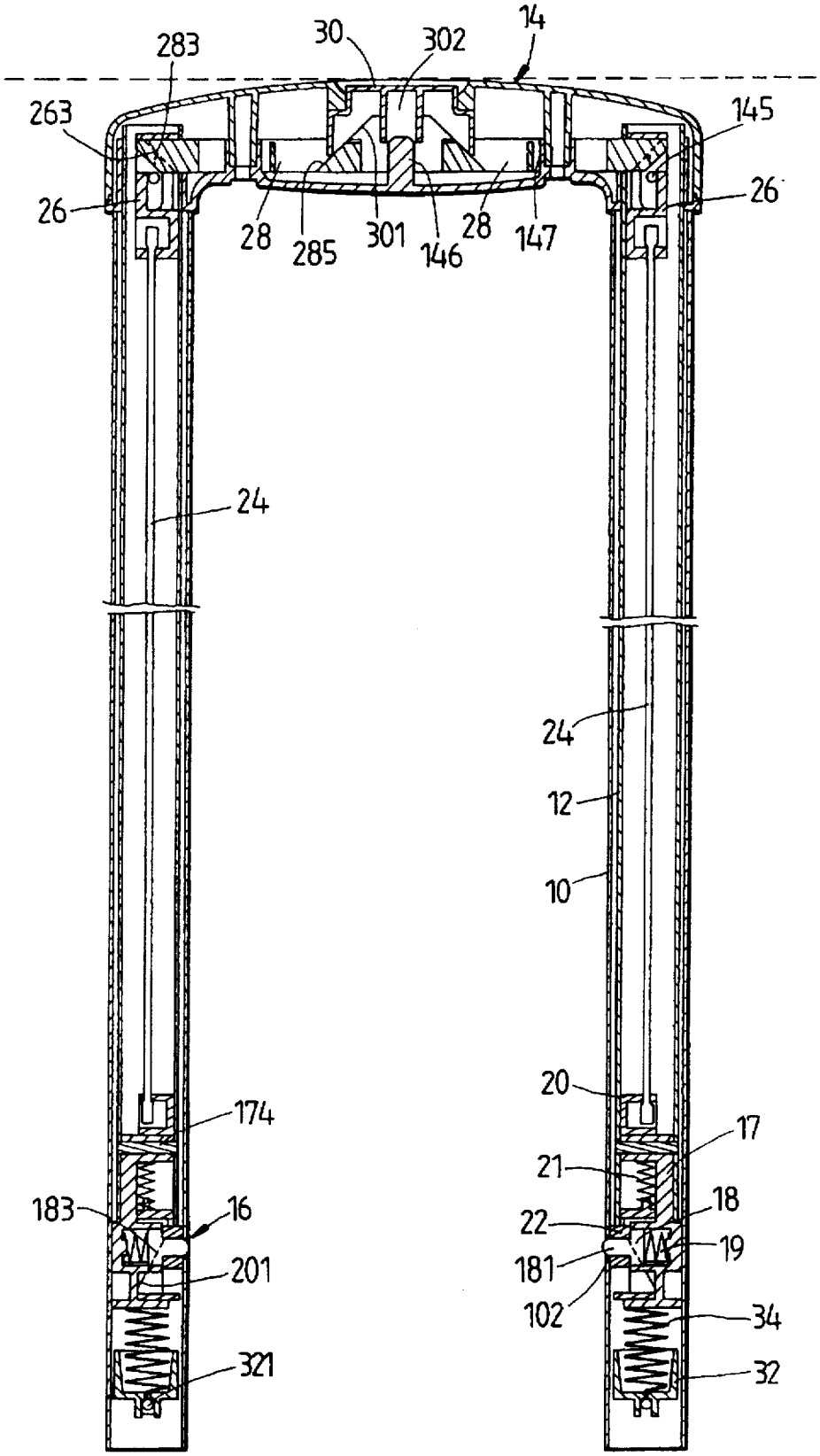
FIG. 2 is a sectional view of the present invention in combination to show that the retaining and arresting members are activated.

As shown in FIGS. 1 and 2, the concealable and expandable handle of the present invention comprises the component parts which are described explicitly hereinafter.

Two outer tubes 10 are parallel to each other and are provided respectively and correspondingly at the upper end and the lower end of opposite sides thereof with a through hole 101 and 102.

Two inner tubes 12 are received respectively and movably in the axial holes of the outer tubes 10.

A hand grip 14 is fastened at both ends thereof with the upper ends of the inner tubes 12 and is composed of an upper piece 141 and a lower piece 142. The upper piece 141 is provided at the center thereof with a cut 143 while the lower piece is provided respectively at both ends thereof with a tubular pivoting portion 144 for connecting and locating each inner tube 12 by a pin 145 only one of which is shown in FIG. 1 for simplicity. The lower piece 142 is provided at the center along the direction of the longitudinal axis thereof with two projections 146 and 147. The pivoting portions 144 are provided respectively with an indentation 148 located in the inner side thereof and perpendicular to the direction of the longitudinal axis of the lower piece 142.

Two retaining and arresting mechanisms 16 are composed of a base 17, a retaining and arresting member 18, a spring 19, a guide member 20, a spring 21, and a locating member 22. The base 17 is located at the bottom end of the inner tube 12 by a pin 174 and is provided with a receiving slot 171 and a cavity 172. The retaining and arresting member 18 has a cylindrical protuberance 181 and a square end portion 182 which is provided respectively on both sides thereof with an inclined surface 183 facing downwards such that the inclined surface 183 is received in the cavity 172 of the base 17. The spring 19 is disposed in such a manner that one end of the spring 19 is pressed against the end portion 182 of the retaining and arresting member 18, and that another end of the spring 19 is pressed against the inner wall of the cavity 172 of the base 17. The spring 19 is intended to provide the elastic force causing the retaining and arresting member 18 to move outwards. The guide member 20 is received in the receiving slot 171 of the base 17 such that the guide member 20 can be caused to move up and down. The guide member 20 is provided with an inclined surface 201 corresponding in location to and engageable with the inclined surface 183 of the retaining and arresting surface 18. The spring 21 has one end urging the guide member 20, and another end urging the base 17. The spring 21 is intended to provide the elastic force for keeping the guide member 20 downwards. The locating member 22 of a C-shaped construction is provided respectively at both ends thereof with a retaining portion 221 engageable with one of two retaining recesses 173 located in both sides of the base 17. The locating member 22 is intended to locate the retaining and arresting member 16, the guide member 20 and two springs 19 and 21 in the base 17. The locating member 22 is provided with a through hole 222 in which the cylindrical protuberance 181 of the retaining and arresting member 18 is received.

Two connection rods 24 are received respectively in the inner tubes 12 such that the bottom ends of the connection rods 24 are connected with the top ends of two guide members 20. The connection rods 24 are intended for use in pulling the guide members 20 to move upwards so as to cause the retaining and arresting member 16 to bring about a releasing action.

Two connection members 26 are mounted respectively on the top ends of the connection rods 24 and are provided respectively with a long hole 261 which is engaged with the pin 145 for use in guiding the connection member 26 to move up and down. The connection members 26 are further provided respectively with a through hole 262 which has in the side wall thereof a slant 263.

Two linking members 28 are provided respectively with a through hole 281 which is engaged pivotally with the projection 147 of the hand grip 14 so as to enable the linking member 28 to move along the direction of the longitudinal axis of the hand grip 14. The linking members 28 are further provided respectively at one end thereof with an arm 282 which is engaged with the indentation 148 in such a manner that one end of the arm 282 is received in the through hole 262 of the linking member 28. The linking members 28 are further provided with a slant 283 corresponding in location to and engageable with the slant 263 of the connection member 26. The through hole 281 is provided respectively in the inner sides thereof with a through hole 284 which is in turn provided in the inner wall thereof with a slant 285.

A press button 30 is located immediately under the hand grip 14 such that the top of the press button 30 is emerged from the cut 143 of the hand grip 14. The press button 30 is provided respectively on two opposite ends of the underside thereof with a slant 301 corresponding in location to and engageable with the slant 285 of the linking member 28. The press button 30 is further provided at the center of the underside thereof with a slot 302 for fastening pivotally the press button 30 with the projection 146.

Two fastening seats 32 are fastened respectively with the bottom end of the outer tube 10 by a pin 321.

Two springs 34 are received respectively in the outer tubes 10 such that the springs 34 are fastened respectively at one end thereof with the fastening seat 32.

The operation of the present invention is illustrated in FIGS. 2–5. As shown in FIG. 2, the handle of the present invention remains folded and arrested at the top of a luggage as indicated by a dotted line. The cylindrical protuberance 181 of the retaining and arresting member 18 is retained in the through hole 102 of the outer tube 10 such that the inner tubes 12 and the outer tubes 10 are located securely, and that the inner tube 12 is completely received in the outer tube 10. In the meantime, the press button 30, two linking members 28, two connection members 26, two connection rods 24, and two guide members 20 remain in an initial state. The springs 34 are compressed.

Figure 3:
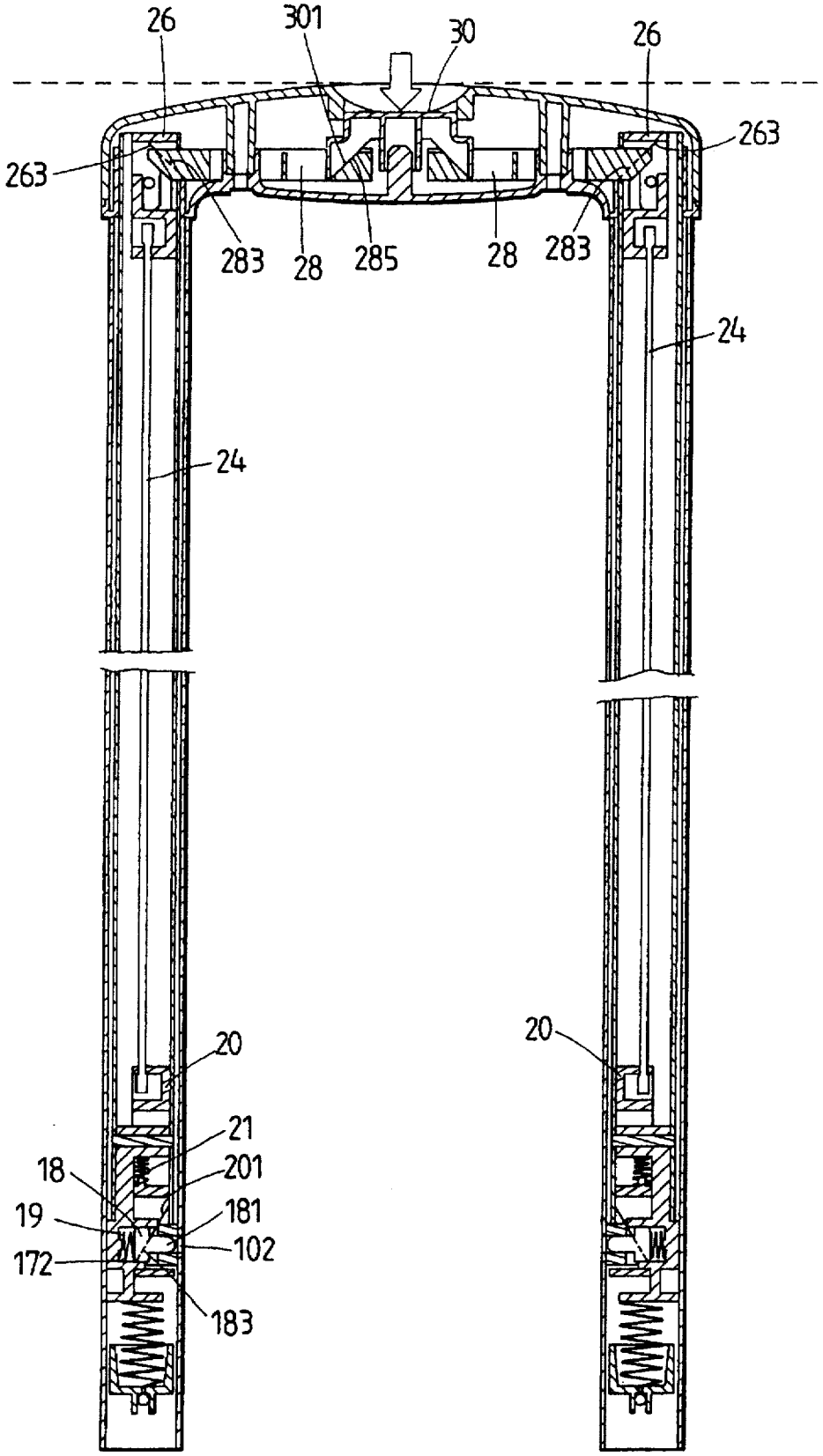
FIG. 3 is similar to FIG. 2 to show that the retaining and arresting members are inactivated.

As shown in FIG. 3, when the press button 30 is pressed, the slants 301 of the press button 30 are in contact with the slants 283 of the linking members 28, thereby driving the linking members 28 to move inwards synchronously. The upward displacement of the connection member 26 is actuated by the action of the slants 285 of the linking members 28 and the slants 263 of the connection members 26. The retaining and arresting member 18 is forced to move toward the cavity 172 by the action that the guide members 20 are pulled upwards by the connection rods 24, and by the action of the slants 201 of the guide members 20 and the inclined surfaces 183 of the retaining and arresting members 18. As a result, the cylindrical protuberance 181 of the retaining and arresting member 18 becomes disengaged with the through hole 102 so as to bring about a releasing action. In the meantime, the springs 19 and 21 are compressed.

Figure 4:
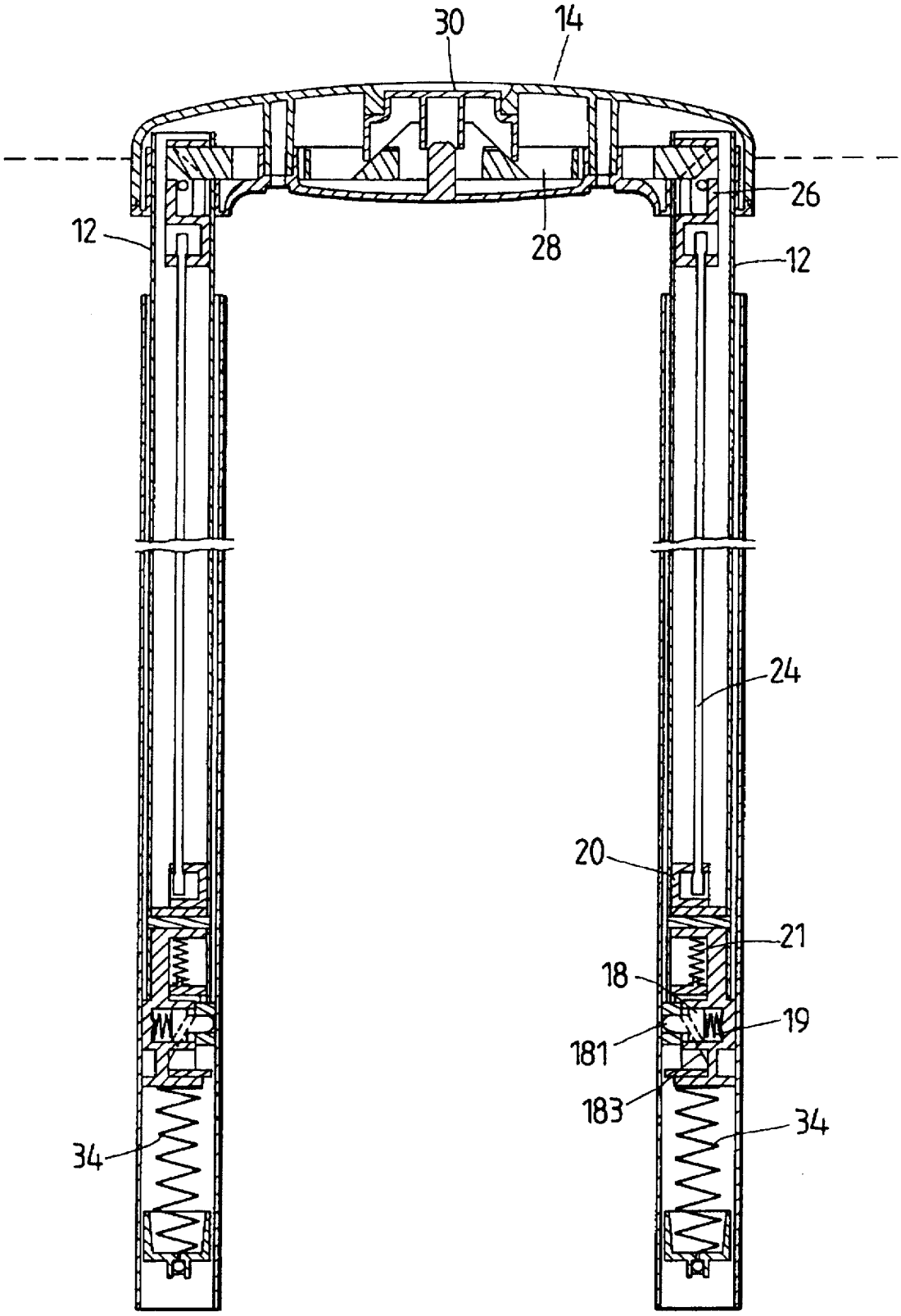
FIG. 4 is similar to FIG. 2 to illustrate that the hand grip is caused to bounce out.

As shown in FIG. 4, the inner tubes 12 and the hand grip 14 are caused by the elastic force of the springs 34 to bounce out after the inner tubes 12 and the hand grip 14 are relieved of the arresting action. The hand grip 14 is bounced out of the top (indicated by a dotted line) of the luggage. The extent to which the hand grip 14 is bounced out can be regulated by adjusting the length and the elasticity of the springs 34. As the press button 30 is relieved of the pressure exerting thereon, the guide members 20, the connection rods 24, the connection members 26, the linking members 28 and the press button 30 are acted on by the stored energy of the springs 19 and 21 to return to their original positions. In the meantime, the retaining and arresting member 18 remains in such a state that the cylindrical protuberance 181 of the retaining and arresting member 18 urges the inner wall of the outer tube 10.

Figure 5:
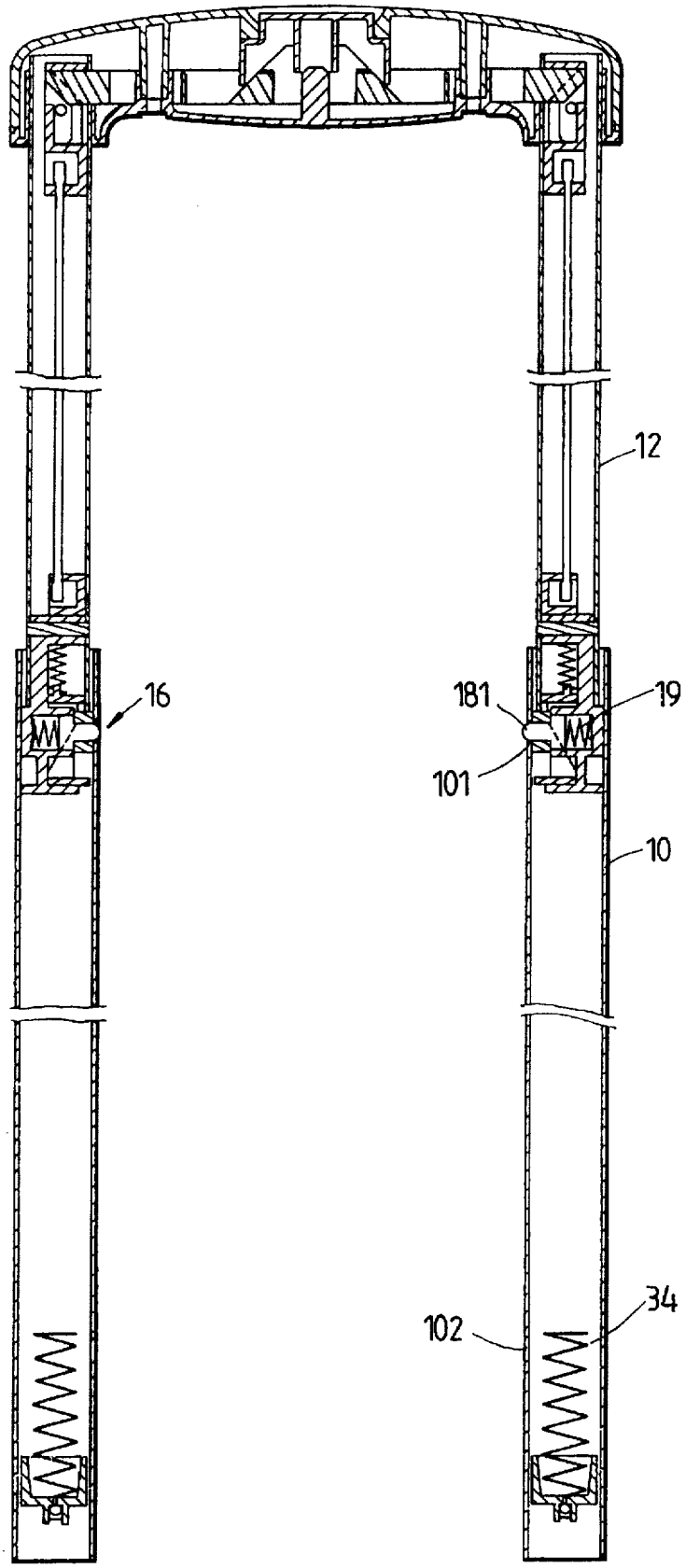
FIG. 5 is similar to FIG. 2 to show that the hand grip remains in the state of being retained and arrested after the hand grip is expanded.

As shown in FIG. 5, the hand grip 14 is drawn out by hand until the cylindrical protuberance 181 is snapped into the though hole 101 of the outer tube 10 by the elastic force of the spring 19. As a result, the inner tubes 12 and the outer tubes 10 are once again arrested and retained to facilitate the pulling or the pushing of the luggage.

The releasing action of the retaining and arresting mechanisms 16 of the present invention is brought about by pressing the press button 30 to cause the inner tubes 12 to withdraw into the outer tubes 10 until the cylindrical protuberance 181 of the retaining and arresting member 18 is snapped into the through hole 102 of the outer tube 10. In the meantime, the springs 34 are compressed to store the energy.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A concealable and expandable handle comprising:

two outer tubes parallel to each other, each upper end and lower end of said two outer tubes respectively having an upper through hole and a lower through hole on a side of each of said two outer tubes opposite each other;

two inner tubes received respectively in an axial hole of said outer tubes such that said inner tubes can be moved freely along said axial hole;

a hand grip fastened at both ends thereof with upper ends of said two inner tubes;

two retaining and arresting means mounted respectively at lower ends of said two inner tubes for locking said two inner tubes relative to said two outer tubes by respectively and separately engaging either each upper through hole or each lower through hole;

two connection rods located respectively in said inner tubes such that said connection rods are fastened respectively at a bottom end thereof with said retaining and arresting means;

two linking members received in said hand grip such that said two linking members are fastened respectively at one end thereof with said connection rods; and a press button located in said hand grip such that said press button can be activated to drive said linking members so as to actuate said connection rods to cause said two retaining and arresting means to release said two inner tubes from either each said upper through hole or each said lower through hole;

wherein said outer tubes are provided respectively at a bottom end thereof with a biasing means fastened therewith such that said biasing means is compressed when said retaining and arresting means are engaged respectively in each said lower through hole; and wherein said hand grip and said inner tubes are forced to bounce out by said biasing means when said press button is exerted on by an external force to release said retaining and arresting means from engagement with each said lower through hole.

2. The handle as defined in claim 1, wherein said hand grip is provided at the center of an upper portion thereof with a cut; wherein said press button is movably located in said cut and each end of said press button is provided respectively on an underside thereof with an inclined surface; wherein said two linking members are movably located at both ends of said hand grip and are provided respectively at an inner end thereof with a slant corresponding in location to and engageable with said inclined surface of said press button when said press button is exerted on by an external force to bring about a synchronous inward movement of said two linking members, said two linking members further provided respectively at an outer end thereof with a slant; and wherein said two connection rods are provided respectively at a top end thereof with a connection member intended to fasten to with said outer end of said linking members, said connection rods further provided respectively with a slant corresponding in location to and engageable with said slant located at said outer end of said linking members, said two connection members capable of moving upwards when said slants located at said outer ends of said two linking members are engaged with said slants of said connection rods so as to bring about said release of said retaining and arresting means.

3. The handle as defined in claim 1, wherein said retaining and arresting means comprises:

a base fastened at a bottom end of said inner tube;

a retaining and arresting member received in said base and provided with a protuberance engageable with either said upper through hole or said lower through hole of said outer tube; said protuberance provided with two inclined surfaces;

a biasing means disposed such that one end of said biasing means urges said protuberance, and that another end of said biasing means urges said base;

a guide member mounted movably in said base and provided with a slant engageable with said slant of said retaining and arresting member, said guide member being fastened at one end thereof with said connection rods such that said guide member can be actuated by said connection rods to cause said protuberance of said retaining and arresting member to become disengaged with either said upper through hole or said lower through hole of said outer tube;

a biasing means disposed in such a way that one end of said biasing means urges said guide member, and that another end of said biasing means urges said base; and a locating member fastened with said base for locating said retaining and arresting member, said guide member and said two biasing means in said base, said locating member having a through hole corresponding in location to said protuberance of said retaining and arresting member.

4. A concealable and expandable handle comprising:

two outer tubes parallel to each other, each upper end and lower end of said two outer tubes respectively having an upper through hole and a lower through hole on a side of each of said two outer tubes opposite each other;

two inner tubes received respectively in an axial hole of said outer tubes such that said inner tubes can be moved freely along said axial hole;

a hand grip fastened at both ends thereof with upper ends of said two inner tubes;

two retaining and arresting means mounted respectively at lower ends of said two inner tubes for locking said two inner tubes relative to said two outer tubes by respectively engaging either each upper through hole or each lower through hole;

two connection rods located respectively in said inner tubes such that said connection rods are fastened respectively at a bottom end thereof with said retaining and arresting means;

two linking members received in said hand grip such that said two linking members are fastened respectively at one end thereof with said connection rods; and a press button located in said hand grip such that said press button can be activated to drive said linking members so as to actuate said connection rods to cause said two retaining and arresting to release said two inner tubes from either each said upper through hole or each said lower through hole;

wherein said outer tubes are provided respectively at a bottom end thereof with a biasing means fastened therewith such that said biasing means is compressed when said retaining and arresting means are engaged respectively in each said lower through hole; and wherein said hand grip and said inner tubes are forced to bounce out by said biasing means when said press button is exerted on by an external force to release said retaining and arresting mean from engagement with each said lower through hole;

wherein said hand grip is provided at the center of an upper portion thereof with a cut; wherein said press button is movably located in said cut and each end of said press button is provided respectively on an underside thereof with an inclined surface; wherein said two linking members are movably located at both ends of said hand grip and are provided respectively at an inner end thereof with a slant corresponding in location to and engageable with said inclined surface of said press button when said press button is exerted on by an external force to bring about a synchronous inward movement of said two linking members, said two linking members further provided respectively at an outer end thereof with a slant; and wherein said two connection rods are provided respectively at a top end thereof with a connection member intended to fasten to with said outer end of said linking members, said connection rods further provided respectively with a slant corresponding in location to and engageable with said slant located at said outer end of said linking members, said two connection members capable of moving upwards when said slants located at said outer ends of said two linking members are engaged with said slants of said connection rods so as to bring about said release of said retaining and arresting means.

5. The handle as defined in claim 4, wherein said retaining and arresting means comprises:

a base fastened at a bottom end of said inner tube;

a retaining and arresting member received in said base and provided with a protuberance engageable with either said upper through hole or said lower through hole of said outer tube; said protuberance provided with two inclined surfaces;

a biasing means disposed such that one end of said biasing means urges said protuberance, and that another end of said biasing means urges said base;

a guide member mounted movably in said base and provided with a slant engageable with said slant of said retaining and arresting member, said guide member being fastened at one end thereof with said connection rods such that said guide member can be actuated by said connection rods to cause said protuberance of said retaining and arresting member to become disengaged with either said upper through hole or said lower through hole of said outer tube;

a biasing means disposed in such a way that one end of said biasing means urges said guide member, and that another end of said biasing means urges said base; and a locating member fastened with said base for locating said retaining and arresting member, said guide member and said two biasing means in said base, said locating member having a through hole corresponding in location to said protuberance of said retaining and arresting member.

* * * * *